US006919575B2

(12) United States Patent
Shilton

(10) Patent No.: US 6,919,575 B2
(45) Date of Patent: Jul. 19, 2005

(54) RADIOACTIVE SOURCES

(75) Inventor: Mark Golder Shilton, Chelmsford, MA (US)

(73) Assignee: Aba Technology PLC, Didcot (GB)

( * ) Notice: Subject to any disclaimer, the term of this patent is extended or adjusted under 35 U.S.C. 154(b) by 0 days.

(21) Appl. No.: 10/482,658

(22) PCT Filed: Jun. 4, 2003

(86) PCT No.: PCT/GB03/02456

§ 371 (c)(1),
(2), (4) Date: Jan. 5, 2004

(87) PCT Pub. No.: WO03/107357

PCT Pub. Date: Dec. 24, 2003

(65) Prior Publication Data

US 2004/0164255 A1 Aug. 26, 2004

(30) Foreign Application Priority Data

Jun. 15, 2002 (GB) ..... 0213854

(51) Int. Cl.[7] ..... G21G 4/00

(52) U.S. Cl. ..... 250/493.1; 250/492 R; 250/385; 340/232

(58) Field of Search ..... 250/493.1, 492 R, 250/385; 340/232; 52/823; 83/43; 53/39

(56) References Cited

U.S. PATENT DOCUMENTS 3,611,850 A * 10/1971 Elliot et al. ..... 83/43
4,187,432 A 2/1980 Mileham ..... 250/493

FOREIGN PATENT DOCUMENTS

GB 1557187 12/1979

* cited by examiner

*Primary Examiner*—John R. Lee
*Assistant Examiner*—Zia R. Hashmi
(74) *Attorney, Agent, or Firm*—William H. Holt

(57) ABSTRACT

Radioactive sources are made from a foil (10) containing radioactive material, by cutting out hexagonal foil elements (12) from the foil, leaving no uncut portions of foil between adjacent hexagonal foil elements. This significantly induces wastage of radioactive foil.

9 Claims, 1 Drawing Sheet

RADIOACTIVE SOURCES

This invention relates to a radioactive source, and to a method of making the source.

Radioactive sources, particularly those used in smoke detectors, may contain radioactive material embedded in a foil of non-radioactive material. For example americium may be provided in the form of a 1 $\mu$m thick layer of americium oxide/gold composite, covered by say a 2 $\mu$m thick layer of gold, and supported on a laminated silver substrate of thickness say 150 $\mu$m. The substrate ensures that the foil is easy to handle. Such a laminated foil may be made by repeated rolling, with repeated addition of backing layers. Small sources can then be punched out of the laminated foil, and located in holders.

According to the present invention there is provided a method of making a multiplicity of radioactive sources from a foil containing radioactive material, by cutting out a multiplicity of hexagonal foil elements from the foil, leaving no uncut portions of foil between adjacent hexagonal foil elements.

Conventional cutting out procedures leave uncut portions of foil between adjacent foil elements, because the foil elements are circular. By making hexagonal foil elements, the foil elements can be from contiguous parts of the foil, and no gaps need be left between them. Consequently the present invention leads to much reduced wastage of the radioactive foil.

A preferred method of cutting out the hexagonal foil elements entails first punching out alternate lines of hexagonal foil elements, leaving intervening uncut strips with zigzag sides; and then cutting across the uncut strips to form hexagonal foil elements.

Preferably each hexagonal foil element is subsequently located in a holder. It is preferably located in a recess, and may be secured in position by crimping the wall of the recess. If the recess is circular this may entail at least five crimped positions around the wall, or alternatively the entire circumference of the wall may be crimped over.

The invention will now be further and more particularly described, by way of example only, and with reference to the accompanying drawings in which.

Figure 1:
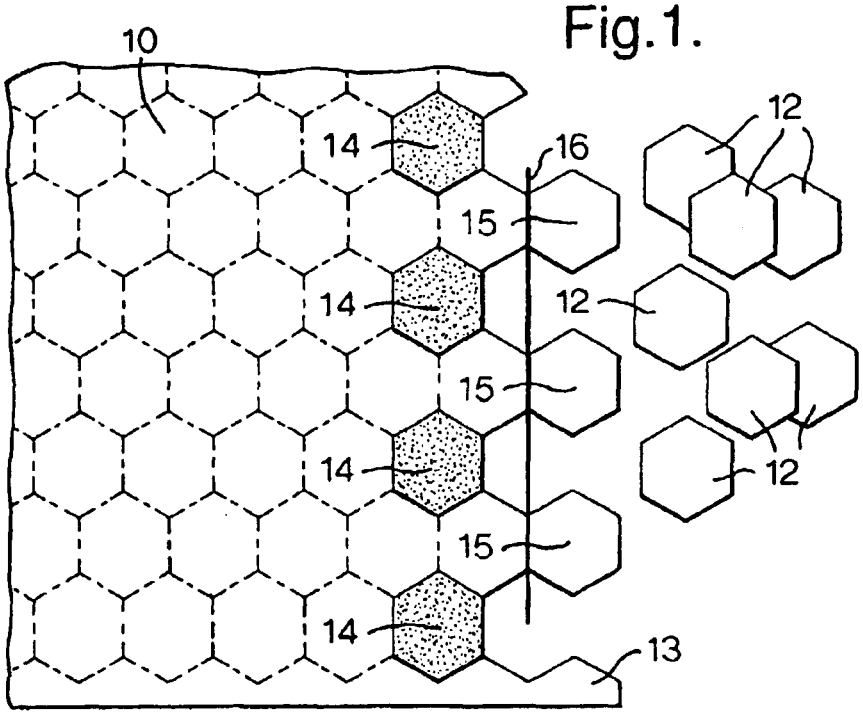
FIG. 1 shows a plan view illustrating how the foil is cut to form foil elements.

Referring now to FIG. 1, this illustrates diagrammatically how the foil is to be cut. A sheet of foil 10 containing radioactive material is to be cut so that at least the bulk of the foil is cut up to form hexagonal foil elements 12 which were initially contiguous, so that no gaps are left between adjacent foil elements 12. The drawing shows a part of the foil 10, showing the lines along which it is intended to cut the foil 10 as broken lines, although it will be appreciated that no such lines would appear on the foil 10. The foil 10 is initially rectangular, and along the edges there are uncut strips 13. In this example a row of hexagonal punches 14 is arranged to cut out a row of spaced-apart foil elements 12 across the entire width of the foil 10 so leaving projecting strips 15 of uncut foil with zigzag sides. A cutting tool 16 is then arranged to cut off the ends of the projecting strips 15, so cutting off hexagonal foil elements 12. The foil 10 is then moved forwards (to the right, in the drawing) by a distance equal to the width of a foil element 12, and the punches 14 activated to cut out the next row of spaced-apart foil elements 12, and the cutting tool 16 activated to cut off the next set of ends of the projecting strips 15. This procedure is then performed repeatedly to cut the entire foil 10 into foil elements 12.

Figure 2:
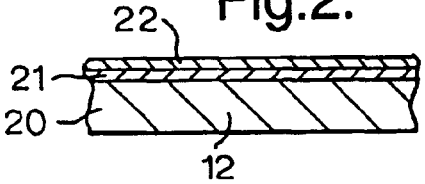
FIG. 2 shows a sectional view through a foil element.

Referring now to FIG. 2, which shows part of a foil element 12 in cross-section (not to scale), the foil element 12 consists of a laminated foil 20 of silver of thickness 125 $\mu$m, on whose upper surface is a 1 $\mu$m thick layer 21 of americium oxide/gold composite, covered by a gold layer 22 of thickness 2 $\mu$m, these thicknesses being by way of example. Each foil element 12 might for example be of width 2 mm (between opposite parallel sides) and contain 0.25 $\mu$g of americium-241, which is an alpha-emitter with a half life of about 430 years. The activity of such a source is about 0.9 $\mu$Ci. The gold layer 22 is sufficiently thin not to significantly reduce the emission of alpha particles. The foil 10 from which the foil element 12 is cut out may be made by a repeated rolling procedure, or a combination of rolling and electodeposition.

Figure 3:
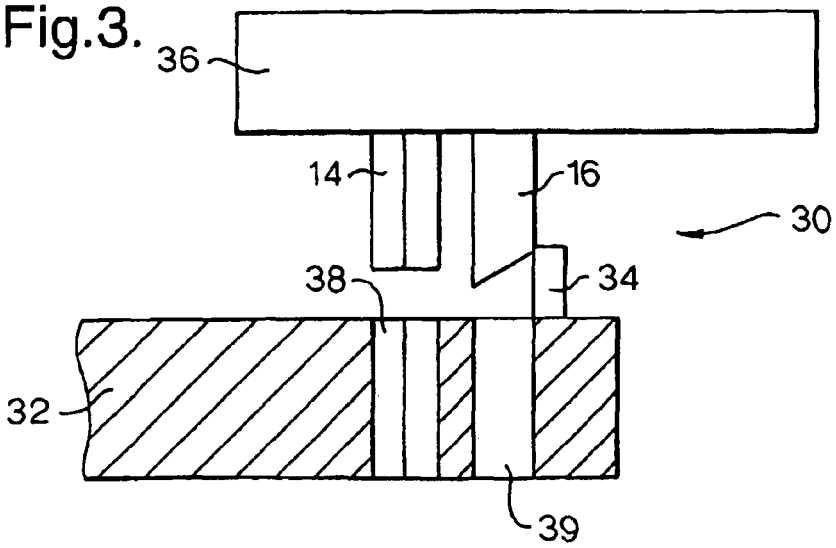
FIG. 3 shows a side elevation of a tool for cutting out the foil elements.

Referring now to FIG. 3, this shows somewhat diagrammatically, and partly in section, a side view of a tool or mechanism 30 for cutting out the foil elements 12. The foil 10 (not shown in FIG. 3) is fed along the top surface of a steel plate 32. (from the left, as shown) so that its end abuts an end stop 34. A cutting mechanism 36 pushes down a set of hexagonal punches 14 and a cutting blade 16, so they mate with corresponding hexagonal apertures 38 and a rectangular slot 39 in the plate 32 respectively. As they mate with the apertures 38 and the slot 39 they cut out the foil elements 12 in the manner described in relation to FIG. 1, and the elements 12 fall down through the apertures 38 and the slot 39 to emerge below the plate 32. The mechanism 36 then raises the punches 14 and the plate 16, so the foil 12 can be fed forward again.

Figure 4:
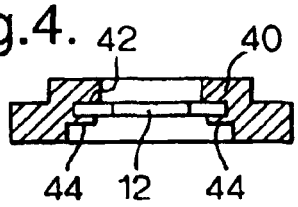
FIG. 4 shows a longitudinal sectional view through a source incorporating a foil element.

The foil elements 12 are typically secured in a holder, for use. One such type of holder 40 is shown in FIG. 4, consisting of a circular stainless-steel ring with a step 42 in the bore. The element 12 (shown in elevation) fits within the wider part of the circular bore, resting against the step 42, with the upper surface (from which the radiation is emitted) exposed through the narrower part of the circular bore. The element 12 is then secured in position by crimping the wall of the wider part of the bore, as indicated at 44. This crimping may be performed at a number of locations around the wall, preferably at least five, or around the entire wall of the bore. It will be appreciated that the holder 40 is only one type of holder that might be used with the foil elements 12. Another type of holder (not shown) has a blind circular recess on one surface; the element 12 is located into the circular recess with its upper surface exposed, and the walls of the recess are crimped in to fix the element 12 into position in substantially the same way as described above.

It will be appreciated that the hexagonal foil elements may be of a different size to that described above, and may contain a different radioactive material. Furthermore the method of cutting out the foil elements may be different from that described in relation to FIG. 3. For example the hexagonal punches 14 may be arranged as two parallel lines rather than a single line; referring to FIG. 1, alternate punches 14 might be in a position say two hexagons to the left of that shown, so the punches 14 are staggered so as to form two parallel lines. The cutting blade 16 might be spaced further away, say one further hexagon, from the line or lines of punches 14. The punches 14 and the cutting blade 16 might operate alternately rather than simultaneously. Furthermore in place of the end stop 34 there might instead be a linear array of pins (not shown) between the cutting blade 16 and the array of punches 14, the pins fitting between the zigzag edges of the protruding portions of foil; in this case after punching out the hexagonal elements with the punches 14 the foil 10 would be pushed forward so the pins abut against the cut edges of the foil 10 (acting as an end stop), and the blade 16 then activated to cut off the end-most protruding hexagonal elements.

The hexagonal shape of the elements reduces the amount of waste material generated by the cutting out process, because no gaps need be left between adjacent foil elements when cutting. Once mounted in the circular holder the hexagonal edges are hidden by the holder, so there is less area of foil used per source; in comparison, with a circular foil element a larger area of foil is effectively wasted, being concealed by the holder. The resulting source has exactly the same output as would be obtained with a circular foil element, as it is only the exposed part of the element that contributes to source activity.

What is claimed is:

1. A method of making a multiplicity or radioactive sources from a foil containing radioactive material, comprising the steps of cutting out a multiplicity of hexagonal foil elements from the foil, leaving no uncut portions of foil between adjacent hexagonal foil elements; providing a holder having a recess therein and a wall adjacent to said recess; locating each such hexagonal foil element in a recess in a respective holder; and securing each foil element in the recess by deforming the adjacent wall of the holder.

2. A method as claimed in claim 1 comprising first punching out alternate lines of hexagonal foil elements, leaving intervening uncut strips with zigzag sides; and then cutting across the uncut strips to form hexagonal foil elements.

3. A method as claimed in claim 1 wherein the foil elements are of a laminated metal foil.

4. A method as claimed in claim 1 wherein the entire circumference of the wall is deformed to secure the foil element.

5. A radioactive source comprising a hexagonal foil element containing radioactive material, and a holder defining a recess in which the foil element locates, said holder including a wall adjacent to said recess, wherein the foil element is secured in the recess by a deformation of the adjacent wall of the holder.

6. A method as claimed in claim 2 wherein the foil elements are of a laminated metal foil.

7. A method as claimed in claim 1 wherein the wall adjacent to the recess is deformed at a number of locations to secure the foil element.

8. A radioactive source as claimed in claim 5 wherein the entire circumference of the wall is deformed to secure the foil element.

9. A radioactive source as claimed in claim 5 wherein the wall adjacent to the recess is deformed at a number of locations to secure the foil element.

* * * * *

UNITED STATES PATENT AND TRADEMARK OFFICE

CERTIFICATE OF CORRECTION

PATENT NO. : 6,919,575 B2
DATED : July 19, 2005
INVENTOR(S) : Mark Golder Shilton It is certified that error appears in the above-identified patent and that said Letters Patent is hereby corrected as shown below:

Title page,
Item [73], Assignee, should read -- AEA Technology PLC --.
Item [57], ABSTRACT,
Line 4, change "induces" to -- reduces --.

Signed and Sealed this

Sixteenth Day of May, 2006

JON W. DUDAS
*Director of the United States Patent and Trademark Office*